US006571477B1

(12) United States Patent
Mothena et al.

(10) Patent No.: US 6,571,477 B1
(45) Date of Patent: Jun. 3, 2003

(54) POCKET CUTTER FOR PLASTIC STRAP

(75) Inventors: Mark Mothena, Hawthorn Woods, IL (US); Janusz Figiel, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/613,316

(22) Filed: Jul. 11, 2000

(51) Int. Cl.[7] ..... B26B 27/00; B26D 1/02

(52) U.S. Cl. ..... 30/115; 30/280; 30/289; 30/294; 83/435.19; 83/856; 83/909

(58) Field of Search ..... 30/278, 280, 284, 30/DIG. 3, 1, 1.5, 2, 111, 112, 113, 115, 116, 117, 289, 290, 291, 305, 314, 315, 316, 317, 494; 83/435.15, 435.16, 435.19, 856, 932, 425, 431, 909, 437.2, 437.6; 140/26, 123.6, 139, 140, 152

(56) References Cited

U.S. PATENT DOCUMENTS

| | | | | | |
|---|---|---|---|---|---|
| 501,928 | A | * | 7/1893 | Fairbanks | 83/435.19 |
| 533,164 | A | * | 1/1895 | Criswell | 83/435.19 |
| 1,356,941 | A | * | 10/1920 | Rece | 30/290 X |
| 1,478,684 | A | * | 12/1923 | Taylor et al. | 83/435.19 |
| 2,120,375 | A | * | 6/1938 | Shaver et al. | 83/435.19 |
| 2,283,029 | A | * | 5/1942 | Bakewell | 83/435.19 |
| 2,407,924 | A | * | 9/1946 | Garfunkel | 83/435.19 |
| 2,497,289 | A | * | 2/1950 | Bloomfield | 83/435.19 |
| 3,114,277 | A | * | 12/1963 | Clendenin | 30/113 X |
| 4,028,802 | A | * | 6/1977 | Houghton et al. | 30/294 |
| 4,644,646 | A | | 2/1987 | Ladin | 30/2 X |
| 4,831,734 | A | | 5/1989 | De Ruyter et al. | 30/278 X |

FOREIGN PATENT DOCUMENTS

| | | |
|---|---|---|
| FR | 2581915 | 11/1986 |

* cited by examiner

*Primary Examiner*—Clark F. Dexter
(74) *Attorney, Agent, or Firm*—Schwartz & Weinrieb

(57) ABSTRACT

A tool for cutting strapping comprises a housing and a slot defined in a base of the housing. A blade is mounted upon the housing, and a handle is pivotally mounted upon the housing between a position remote from the blade and a position adjacent to the blade. A pusher is pivotally mounted upon the handle and is biased into engagement with the base by a spring so as to normally close the entrance to the slot. When strapping is to be cut, the strapping is inserted into the slot causing the pusher to be moved out of the way against the biasing force of its spring. Upon the strapping passing the pusher, the pusher returns to its original position whereby the pusher now engages the strapping. Manipulation of the handle toward the blade causes the pusher to push the strapping into engagement with the blade thereby cutting the strapping.

20 Claims, 4 Drawing Sheets

POCKET CUTTER FOR PLASTIC STRAP

FIELD OF THE INVENTION

The present invention relates generally to manually-operable cutting tools, and more particularly to a new and improved manually-operable cutting tool for cutting plastic strapping wherein the tool is uniquely structured so as to enable an operator to easily position the tool beneath the plastic strapping, and wherein further, the tool is compact, the tool develops a proper cutting force, and the tool is easy to operate so as to be capable of being easily manipulated by means of one hand so as to readily and efficiently sever plastic strapping having different thickness dimensions.

BACKGROUND OF THE INVENTION

Manually-operable cutting tools for severing plastic strapping are of course well-known, such as, for example, a conventional scissors-type cutter or the like wherein a pair of oppositely disposed blade members are manipulated by means of a pair of oppositely disposed handles. In the conventional manner, pivotal closure of the oppositely disposed handles with respect to or toward each other similarly actuates the oppositely disposed blade members to be pivotally moved with respect to or toward each other. Such conventional tools, however, have several operational disadvantages or drawbacks. Firstly, such tools are not particularly compact and are sometimes cumbersome. Secondly, in view of the fact that the blade members are in effect externally exposed or accessible, such tools present or raise safety concerns or issues. Thirdly, in view of the scissors-type manipulation mode characteristic of such tools, the tools sometimes do not develop the proper cutting forces, particularly, for example, when the material to be cut has a significant thickness dimension, and in addition, the tools are not especially ergonomically beneficial so as to readily enable an operator to perform one-handed cutting operations.

A need therefore exists in the art for a new and improved manually-operable cutting tool for cutting or severing plastic strapping wherein the tool would be substantially compact in size, wherein the tool would readily facilitate the positioning or disposition of the tool beneath plastic strapping to be cut or severed, wherein the tool would enable the generation of proper cutting forces, wherein the tool would enable or easily facilitate a one-handed cutting or severing operation to be performed, and wherein the cutting blade or the cutting edge of the cutting blade would be effectively enclosed within an interior portion of the tool such that the cutting edge of the cutting blade does not present any safety hazards.

OBJECTS OF THE INVENTION

Accordingly, it is an object of the present invention to provide a new and improved manually-operated cutting tool for cutting or severing plastic strapping.

Another object of the present invention is to provide a new and improved manually-operated cutting tool for cutting or severing plastic strapping wherein the tool overcomes the various operational disadvantages or drawbacks characteristic of PRIOR ART manually-operated cutting tools.

An additional object of the present invention is to provide a new and improved manually-operated cutting tool for cutting or severing plastic strapping wherein the tool is relatively compact in size, wherein the tool generates proper cutting forces so as to enable the cutting of materials having different thickness dimensions, and wherein the tool enables the cutting or severing operation to be accomplished by means of a one-handed operation.

A further object of the present invention is to provide a new and improved manually-operated cutting tool for cutting or severing plastic strapping wherein the tool is able to be readily or easily positioned beneath the plastic strapping so as to be readied for the cutting or severing operation, and wherein the cutting edge portion of the cutting blade is disposed internally within the tool so as not to present any safety hazards for operator personnel.

SUMMARY OF THE INVENTION

The foregoing and other objectives are achieved in accordance with the teachings and principles of the present invention through the provision of a new and improved manually-operable cutting tool wherein the tool comprises a housing comprising a base portion or foundation, and an upstanding web or rib member attached to the base portion or foundation at the rear end thereof such that an insertion slot, for permitting insertion therewithin of plastic strapping to be cut or severed, is defined between a lower edge portion of the upstanding web or rib member and an upper surface portion of the base portion or foundation. A cutting blade, having a vertically oriented cutting edge, is mounted upon a lower end portion of the upstanding web or rib member and has a lower end portion thereof supported within the base portion or foundation of the housing such that a portion of the cutting blade edge is disposed within the insertion slot so as to in effect be exposed to the plastic strapping when the same is inserted into the insertion slot so as to be cut or severed. A manually-manipulable handle is pivotally mounted upon the housing, under the influence of a biasing spring such that the handle is normally disposed at an opened inoperative position, and includes a spring-biased pusher element which is pivotally mounted at a forward end portion thereof upon the handle. The pusher element also has a rear end portion thereof which is biased into engagement with the base portion or foundation of the housing by means of its own biasing spring so as to in effect close or cover the entrance to the insertion slot.

When plastic strapping is to be cut or severed, the strap is in effect inserted into the insertion slot by engaging the pusher element and thereby causing the pusher element to be moved out of the way against the biasing force of its biasing spring. Upon the plastic strapping passing by the rear end portion of the pusher element, the pusher element returns to its normally biased position wherein the pusher element now engages the rear edge portion of the plastic strapping. Manipulation of the handle toward the closed position causes the pusher element to push the plastic strapping into engagement with the cutting edge of the cutting blade whereby the plastic strapping is cut or severed.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
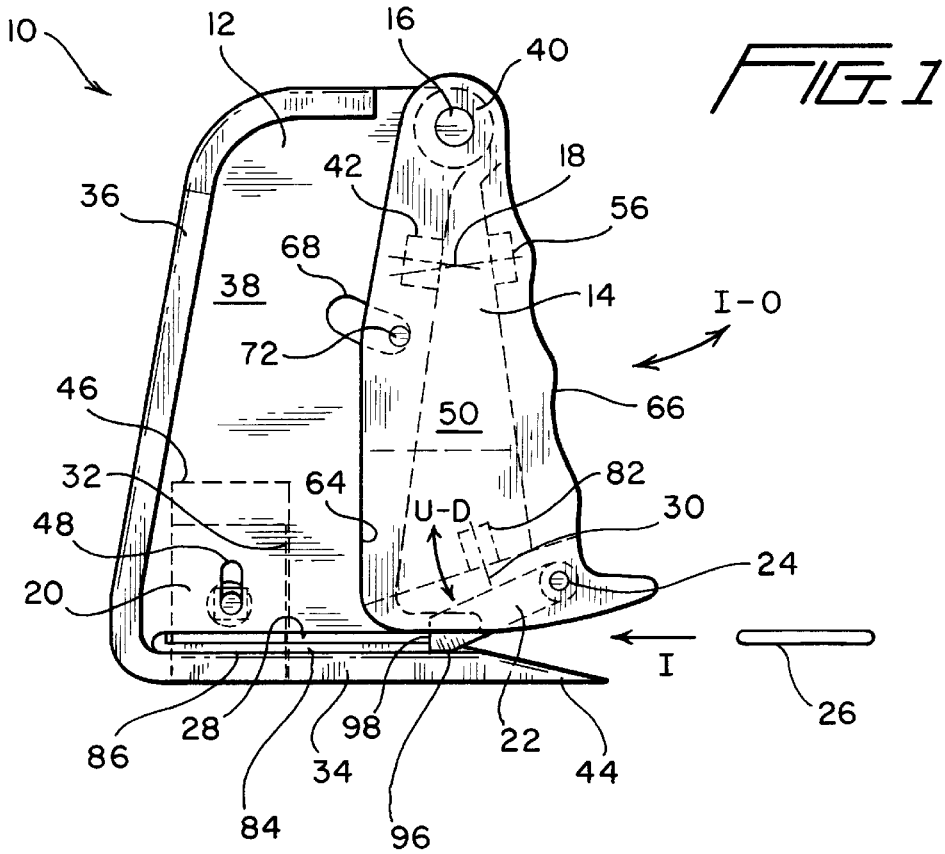
FIG. 1 is a side elevational, partially schematic, view of a new and improved manually-operable cutting tool constructed in accordance with the principles and teachings of the present invention and showing the cooperative parts thereof in preparation for a cutting operation to be performed upon plastic strapping.

Referring now to the drawings, and more particularly to FIG. 1 thereof, a new and improved manually-operable cutting tool constructed in accordance with the principles and teachings of the present invention and showing the cooperative parts thereof is disclosed and is generally indicated by the reference character 10. The cutting tool 10 will firstly be generally described in order to provide an overall appreciation of the construction and operation thereof, and subsequently, details of the various component parts of the tool 10 will then be described such that an appreciation can be obtained with respect to the operational interrelationship defined between the component parts of the tool. More particularly, cutting tool 10 is seen to comprise a housing 12 upon an upper forward end of which a handle 14 is pivotally mounted as at 16, and a first spring 18 is interposed between the housing 12 and the handle 14 such that the handle 14 is normally biased to an inoperative position as shown in FIG. 1 wherein the tool 10 is disposed in a non-cutting mode. A cutting blade 20 is mounted upon a lower rear portion of the housing 12, and the handle 14 is seen to have a pusher element 22 pivotally mounted upon a lower end portion thereof as at 24. Plastic strapping to be cut or severed by means of the tool 10 of the present invention is disclosed at 26, and it is seen that the lower end portion of the tool housing 12 is provided with a slot 28 into which the plastic strapping 26 is to be moved, as denoted by the arrow I, so as to encounter the cutting blade 20 whereby the plastic strapping 26 can be severed. A set of second springs 30, only one of which is shown, are mounted upon the lower end portion of the handle 14 and is engaged with the pusher element 22 so as to normally bias the pusher element 22 to a position at which the pusher element 22 effectively blocks or covers the open end of the slot 28.

As can be appreciated, however, when the plastic strapping 26 is to be inserted into the slot 28, the plastic strapping 26 is moved in the denoted direction I whereupon the plastic strapping 26 encountering the pusher element 22, the pusher element 22 is effectively moved upwardly against the biasing force of the second springs 30 whereby the plastic strapping 26 can be inserted into the slot 28. Upon the strapping 26 clearing or passing by the rear end portion of the pusher element 22, the second springs 30 will bias the pusher element 22 back to its normally biased position at which the rear end portion of the pusher element 22 now engages the rear or right edge portion of the strapping 26 as viewed in FIG. 1, the pivotal movements of the pusher element being noted by the double arrowhead U-D. Accordingly, when the handle 14 is pivotally moved inwardly or toward the left as viewed in FIG. 1, the pivotal movements of the handle 14 being denoted by means of the double arrowhead I-O, the pusher element 22 will force the strapping 26 toward the left into engagement with the cutting edge 32 of the cutting blade 20 whereby strapping 26 is cut thereby completing a strapping cutting operation.

With reference now being made to FIGS. 2–6, the details of the housing 12 will now be described. As can best be appreciated from FIGS. 2–4, the housing 12 is seen to comprise a horizontally disposed base or foundation 34 and a rearwardly disposed, upstanding support member or rib 36 which is integrally connected at its lower end portion to the base or foundation 34. A laterally central or axially disposed web member 38 is in turn integrally connected to the upstanding support member or rib 36, and it is seen that the lower end portion of the web member 38 is spaced from the base or foundation 34 so as to define the aforenoted slot 28 into which the strapping 26 to be cut can be inserted. A pivot pin support or boss 40 is integrally formed at the upper forward end of the web 38 so as to pivotally support the handle 14 thereon, and a recessed socket or pocket portion 42 is defined within an upper forward edge portion of the web 38 for accommodating one end of the first spring 18 which is adapted to be interposed between the web portion 38 of the housing 12 and the handle 14 so as to normally bias the handle 14 toward its opened position which is relatively remote from the upstanding support member or rib 36 of the housing 12. The forwardmost end portion of the base or foundation 34 is provided with a relatively sharp wedge-shaped portion 44 so as to enable the tool 10 to be inserted underneath the strapping 26 to be cut as well as to guide the strapping 26 into the slot 28. Lastly, as best seen or appreciated from FIGS. 4 and 6, a right side portion of the web member 38, as well as a corresponding portion of the base or foundation 34, is provided with a recessed region 46 which has a substantially rectangular configuration so as to house or accommodate the cutting blade 20. In addition, a substantially oval-shaped aperture 48 is defined within the web member 38 and at a substantially central portion of the recessed region 46 so as to provide for vertical adjustment of the cutting blade 20 as will be described more fully in detail hereinafter.

With reference now being made to FIGS. 7–10, the structure of the handle 14 will now be described in detail. As may best be appreciated from FIG. 8, the handle 14 is seen to essentially comprise a bifurcated structure which comprises a pair of laterally separated side wall members 50, 52 which are integrally connected together by means of an end wall member 54. A recessed pocket or socket 56 is defined within the end wall member 54 and is adapted to receive the opposite end of the first spring 18, and it is to be appreciated that the first spring 18 will be confined between the side wall members 50,52. It is also seen that the upper ends of the side wall members 50,52 are each provided with an aperture 58,60 wherein the apertures 58,60 will be axially aligned with the pivot pin support or boss 40 so as to permit a pivot pin, not shown, to be axially disposed therethrough by means of which the handle 14 is pivotally mounted upon the housing 12 as at 16. The lateral separation of the side wall portions 50,52 of the handle 14 defines a central or axial space 62 therebetween within which the forward edge portion 64 of the housing web 38 is able to be freely accommodated when the handle 14 is pivotally moved with respect to the housing 12 in the opposite directions noted by the double arrowhead I-O. In order to comfortably or ergonomically assist the pivotal movement of the handle 14 with respect to the housing 12, the forward vertical portion of the handle 14 is provided with fingergrip portions 66. This structure also corresponds to the provision of the upstanding support member or rib 36 of the housing 12 which will likewise ergonomically fit or be disposed within an operator's palm whereby the tool 10 can be easily or readily manipulated by means of one hand. It is still further noted that the web portion. 38 of the housing 12 is provided with a substantially arcuate, oval-shaped aperture 68, and each one of the side wall portions 50, 52 is also provided with an aperture, only one of which is shown at 70, through which a pin 72 can be disposed such that the pivotal movement of the handle 14 with respect to the housing 12 is limited or confined within a predetermined range of movement.

Figure 8:
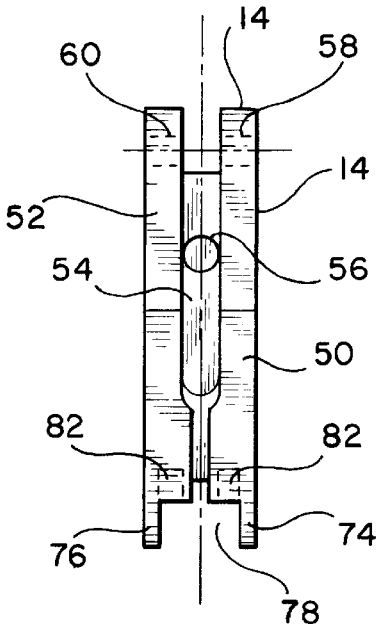
FIG. 8 is an end elevational view of the handle component of the cutting tool shown in FIG. 7.
Figure 9:
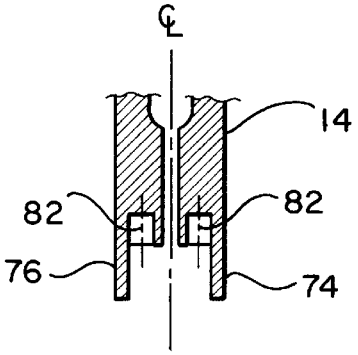
FIG. 9 is a cross-sectional view of the handle component of the cutting tool shown in FIG. 7 as taken along the line 9—9 of FIG. 7.
Figure 10:
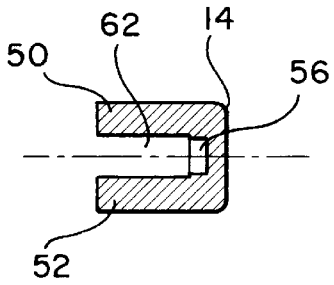
FIG. 10 is a cross-sectional view of the handle component of the cutting tool shown in FIG. 7 as taken along the line 10—10 of FIG. 7.
Figure 4:
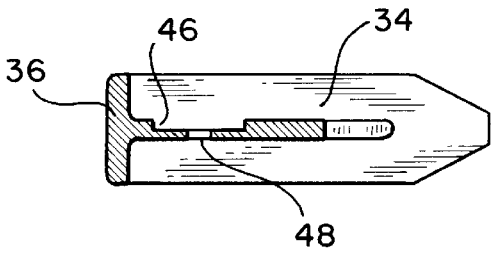
FIG. 4 is a cross-sectional view of the housing component shown in FIG. 2 as taken along the line 4—4 of FIG. 2.
Figure 5:
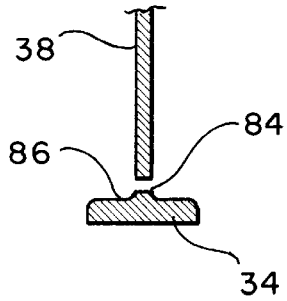
FIG. 5 is a cross-sectional view of the housing component shown in FIG. 2 as taken along the line 5—5 of FIG. 2.
Figure 6:
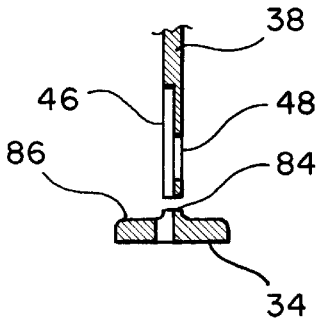
FIG. 6 is a cross-sectional view of the housing component shown in FIG. 2 as taken along the line 6—6 of FIG. 2.
Figure 7:
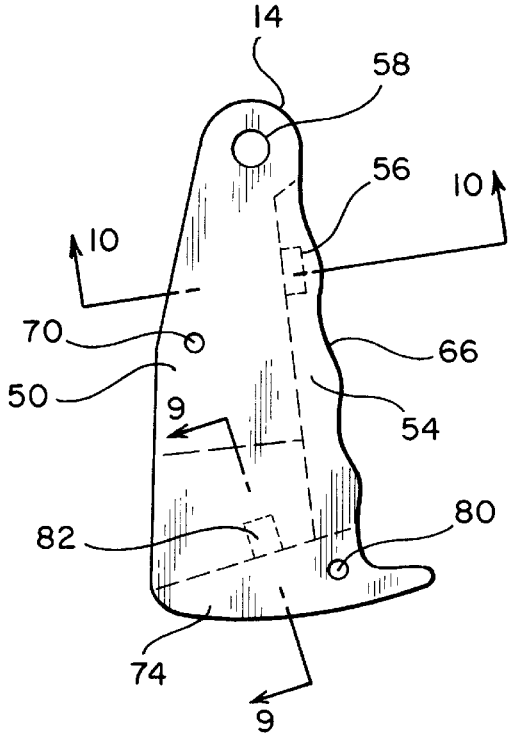
FIG. 7 is a side elevational view of the handle component of the cutting tool shown in FIG. 1.

With reference continuing to be made to FIGS. 7–9, the lower end portion of the handle 14 further comprises a skirt portion which is defined by means of two downwardly dependent side wall portions 74,76 as best seen in FIGS. 8 and 9, and it can be appreciated that the downwardly dependent side wall portions 74, 76 are laterally separated from each other so as to define therebetween a space 78 within which the pusher element 22 can be accommodated as can also be appreciated from FIG. 1. As seen in FIG. 7, each one of the dependent side wall portions 74,76 is also provided with an aperture, only one of which is shown at 80, whereby a pivot pin, not shown, can be inserted or mounted by means of which the pusher element 22 is pivotally mounted upon the handle 14 as at 24. The lower end portion of the handle 14 is further provided with a pair of laterally spaced blind bores 82, 82 within which the pair of second springs 30, 30 for biasing the pusher element 22 are to be disposed. As was the case with the first spring 18, the pair of second springs 30, 30 are effectively laterally confined between the skirt side wall portions 74, 76 such that the springs 30, 30 remain engaged with the pusher element 22.

Figure 11:
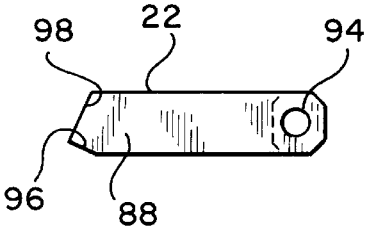
FIG. 11 is a side elevational view of the pusher component of the cutting tool shown in FIG. 1.
Figure 12:
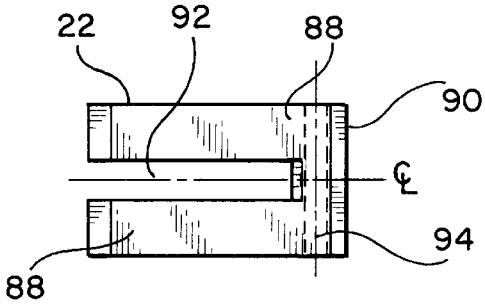
FIG. 12 is a top plan view of the pusher component of the cutting tool shown in FIG. 1.
Figure 2:
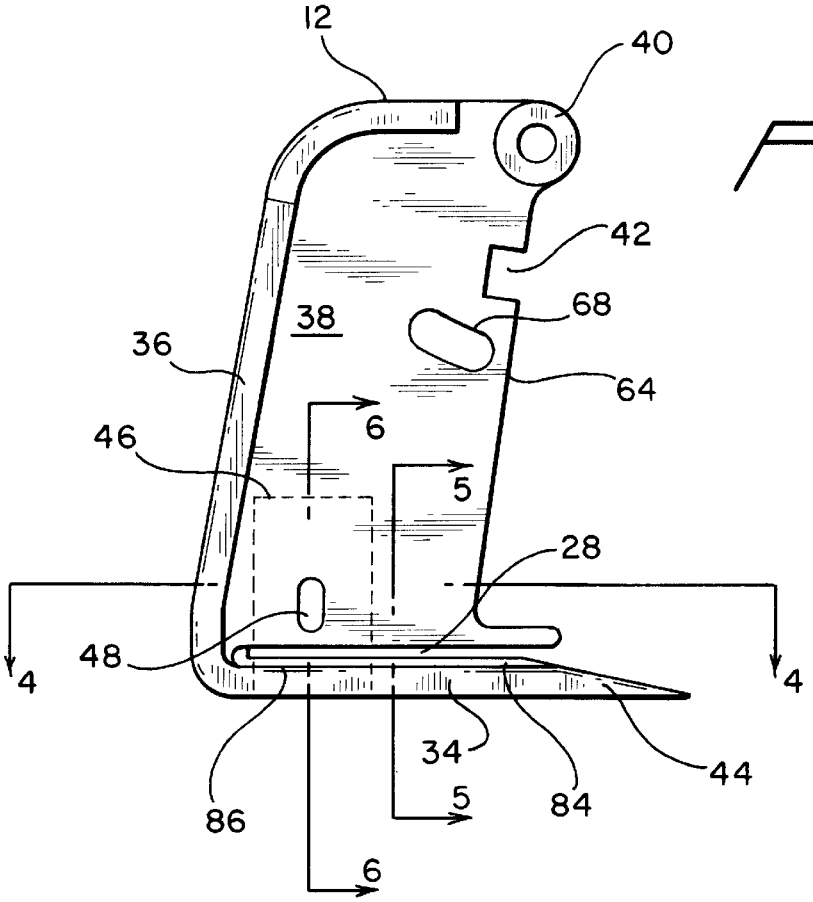
FIG. 2 is a side elevational view of the housing component of the cutting tool shown in FIG. 1.

With reference now being made to FIGS. 11 and 12, the details of the pusher element 22 will be described. Initially, as can best be appreciated from FIGS. 1–3, 5 and 6, the housing base or foundation 34 further includes an upstanding, horizontally extending rib 84 which is separated from the lower edge portion of the web member 38 and axially aligned or coplanar with the web member 38 so as to define the slot 28 therebetween. The rib 84 projects upwardly from the upper surface 86 of the base or foundation 34 upon which the pusher element 22 is adapted to ride when the handle 14 is moved inwardly with respect to the housing 12 in accordance with the arrow portion I of the double arrowhead I-O. Accordingly, the pusher element 22 is provided with unique structure which permits the pusher element 22 to achieve the aforenoted movement during a strapping cutting operation. More particularly, as was the case with the handle 14, the pusher element 22 also comprises a bifurcated structure. As best appreciated from FIG. 12, the pusher element 22 comprises a pair of longitudinally extending, laterally separated side portions 88,88 which are integrally connected together by means of a laterally extending end portion 90. The lateral separation of the side portions 88,88 defines a central or axial space 92 therebetween within which the upstanding rib 84 of the housing base or foundation is able to be accommodated. The end portion 90 is also provided with a laterally or transversely oriented throughbore 94 for accommodating a pivot pin, not shown, whereby the pusher element is pivotally mounted upon the handle 14 as at 24.

As can best be further appreciated from FIG. 11, each one of the side portions 88,88 of the pusher element 22 comprises a rearwardly disposed end portion which comprises an undersurface portion 96 and an end surface portion 98, each surface portion 96,98 being disposed at a predetermined angular orientation with respect to the horizontal. For example, undersurface portion 96 may be disposed at an angle of 25°, while end surface portion 98 may be disposed at an angle of 65°. Accordingly, as can best be appreciated from the assembled view of FIG. 1, when the pusher element 22 is operationally mounted upon the handle 14, it will be seen that each undersurface portion 96,96 will in effect be disposed horizontally upon the upper surface 86 of the base or foundation 34 while each end surface portion 98,98 will now be dis-posed vertically or perpendicular to the upper surface 86 of the base or foundation 34 whereby the end surface portions 98,98 can properly engage the strapping 26 so as to cause or force movement of the strapping 26 into engagement with the cutting edge 32 of the cutting blade 20. The disposition of each undersurface portion 96,96 upon the upper surface 86 of the base or foundation 34, as well as the straddling in effect of each side portion 88,88 upon the opposite sides of the upstanding rib portion 84 of the base or foundation 34, provides controlled stability to the pusher element 22 as the same rides or moves along the upper surface portion 86 of the base or foundation 34 such that proper cutting forces can be generated during a cutting operation being performed upon the strapping 26.

Figure 13:
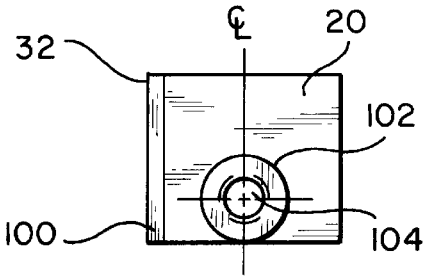
FIG. 13 is a side elevational view of the nut-cutting blade component of the cutting tool shown in FIG. 1.
Figure 14:
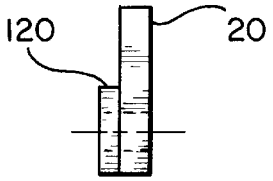
FIG. 14 is an end elevational view of the nut-cutting blade component shown in FIG. 13.
Figure 3:
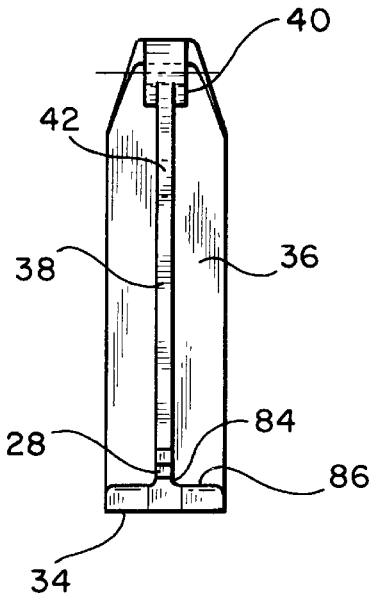
FIG. 3 is an end elevational view of the housing component of the cutting tool as shown in FIG. 2.

With reference lastly being made to FIGS. 13 and 14, the details of the cutting blade 20 will now be described. As can be seen, the cutting blade 20 is provided with a forwardly disposed beveled portion 100 which defines the forwardly disposed cutting edge portion 32. In addition, the cutting blade 20 has upon a side portion thereof an integrally formed nut portion 102 having a throughbore 104 within which a suitable fastener, not shown, can be inserted. The fastener is also adapted to be inserted through the oval-shaped aperture 48 defined within the web member 38. It is also seen that the vertical height or extent of the cutting blade 20 is less than that of the recessed region 46 defined within the sidewall portion of the web member 38 and the base portion or foundation 34. In this manner, the vertical disposition of the cutting blade 20, and more particularly, that of the cutting edge 32 of the cutting blade 20, is thus able to be positionally adjusted, when the fastener, not shown, is appropriately loosened and subsequently tightened, such that new regions of the cutting blade edge 32 can be positioned or aligned with respect to the slot 28, as the cutting blade 20 experiences wear, within which the strapping 26 to be cut is disposed so as to be cut by means of the cutting blade 20.

Thus, it may be seen that in accordance with the principles and teachings of the present invention, there has been provided a manually-operable cutting tool, for cutting or severing plastic strapping, wherein the tool is compact in size and easily manipulable by means of an operator's single hand, and wherein further, the strapping is readily able to be inserted into the housing slot and forced into contact with the cutting blade by means of the pusher element when the handle is pivotally moved relative to the housing. The interior disposition of the cutting blade also renders the tool safe for operator personnel in that the cutting edge of the blade is not externally exposed.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A manually-operated, hand-held cutting tool, capable of being manipulatively operable by an operator's single hand, for cutting a strip of material, comprising:

a housing for engaging a first portion of an operator's hand when said hand-held cutting tool is held within the operator's hand;

an elongated insertion slot, comprising an open end and two oppositely disposed open sides, defined within said housing so as to have a predetermined longitudinal directional orientation along which a strip of material, to be cut, can be inserted into said housing through said open end and moved within said housing;

a cutting blade fixedly mounted upon said housing and having a cutting edge that extends into said insertion slot for cutting the strip of material; and a handle for engaging a second portion of the operator's hand when said hand-held cutting tool is held within the operator's hand and having a portion that is extendable into said insertion slot, wherein said handle is mounted upon said housing for manual manipulable movement with respect to said housing between a first position remote from said cutting blade so as to permit the strip of material to be inserted into said insertion slot along said predetermined longitudinal directional orientation and thereby be disposed adjacent to said cutting blade, and a second position adjacent to said cutting blade such that, when said handle is moved from said first position to said second position, said portion of said handle, extending into said insertion slot, engages the strip of material and forces the strip of material to be moved along said predetermined longitudinal directional orientation and into contact with said cutting blade whereby said cutting blade cuts the strip of material.

2. A manually-operated cutting tool as set forth in claim 1, wherein said housing comprises:

a base portion; and an upstanding web portion integrally attached to said base portion;

said insertion slot defined within said housing is located between said base portion and a lower end portion of said upstanding web portion so as to permit insertion of the strip of material into said housing such that said portion of said handle can force the strip of material into engagement with said cutting blade so as to be severed by said cutting blade.

3. A manually-operated cutting tool as set forth in claim 2, wherein:

said portion of said handle for forcing the strip of material into engagement with said cutting blade comprises a pusher element which is pivotally mounted upon said handle between a first position at which said pusher element can permit the strip of material to be inserted into said insertion slot of said housing in preparation for a cutting operation by said cutting blade, and a second position at which said pusher element can engage the strip of material so as to force the strip of material into engagement with said cutting blade as said handle is moved from said first position remote from said cutting blade to said second position adjacent to said cutting blade.

4. A manually-operated cutting tool as set forth in claim 3, wherein:

said base portion of said housing comprises an upstanding rib member; and said pusher element comprises a bifurcated structure having a pair of laterally separated side portions defining a space therebetween for accommodating said rib member of said base portion of said housing and for permitting movement of said pusher element along said base portion of said housing as said handle is moved from said first position remote from said cutting blade to said second position adjacent to said cutting blade.

5. A manually-operated cutting tool as set forth in claim 2, wherein:

said handle comprises a bifurcated structure having a pair of laterally separated side wall portions defining a space therebetween for accommodating said web portion of said housing and for permitting movement of said handle from said first position remote from said cutting blade to said second position adjacent to said cutting blade.

6. A manually-operated cutting tool as set forth in claim 1, further comprising:

a first spring member interposed between said housing and said handle for normally biasing said handle to said first position remote from said cutting blade.

7. A manually-operated cutting tool as set forth in claim 6, wherein:

said portion of said handle comprises a pusher element; and a second spring member is interposed between said handle and said pusher element for normally biasing said pusher element toward said insertion slot.

8. A manually-operated cutting tool as set forth in claim 6, wherein:

an elongated aperture is defined within said housing; and a pin is mounted upon said handle and disposed within said aperture of said housing for limiting the movement of said handle with respect to said housing from said second position adjacent to said cutting blade toward said first position remote from said cutting blade under the influence of said first spring member.

9. A manually-operated cutting tool as set forth in claim 1, further comprising:

means for mounting said cutting blade upon said hous-ing for permitting said cutting blade to be adjustably movable upon said housing whereby new portions of said cutting blade are positioned for performing a cutting operation as said cutting blade experiences wear.

10. A manually-operated cutting tool as set forth in claim 1, wherein:

said handle comprises fingergrip portions; and said housing comprises a palm-support portion, whereby said manually-operable cutting tool is able to be manipulated by an operator in accordance with a one-handed operation.

11. A manually-operated, hand-held cutting tool, capable of being manipulatively operable by an operator's single hand, for cutting plastic strapping material, comprising:

a housing for engaging a first portion of an operator's hand when said hand-held cutting tool is held within the operator's hand;

an elongated insertion slot, comprising an open end and two oppositely disposed open sides, defined within said housing so as to have a predetermined longitudinal directional orientation along which plastic strapping material, to be cut, can be inserted into said housing through said open end and moved within said housing;

a cutting blade fixedly mounted upon said housing and having a cutting edge that extends into said insertion slot for cutting the plastic strapping material; and a handle for engaging a second portion of the operator's hand when said hand-held cutting tool is held within the operator's hand and having a portion that is extendable into said insertion slot, wherein said handle is mounted upon said housing for manual manipulable movement with respect to said housing between a first position remote from said cutting blade so as to permit the plastic strapping material to be inserted into said insertion slot along said predetermined longitudinal directional orientation and thereby be disposed adjacent to said cutting blade, and a second position adjacent to said cutting blade such that, when said handle is moved from said first position to said second position, said portion of said handle, extending into said insertion slot, engages the plastic strapping material and forces the plastic strapping material to be moved along said predetermined longitudinal directional orientation and into contact with said cutting blade whereby said cutting blade cuts the plastic strapping material.

12. A manually-operated cutting tool as set forth in claim 11, wherein said housing comprises:

a base portion; and an upstanding web portion integrally attached to said base portion;

said insertion slot defined within said housing is located between said base portion and a lower end portion of said upstanding web portion so as to permit insertion of the plastic strapping material into said housing such that said portion of said handle can force the plastic strapping material into engagement with said cutting blade so as to be severed by said cutting blade.

13. A manually-operated cutting tool as set forth in claim 12, wherein:

said portion of said handle for forcing the plastic strapping material into engagement with said cutting blade comprises a pusher element which is pivotally mounted upon said handle between a first position at which said pusher element can permit the plastic strapping material to be inserted into said insertion slot of said housing in preparation for a cutting operation by said cutting blade, and a second position at which said pusher element can engage the plastic strapping material so as to force the plastic strapping material into engagement with said cutting blade as said handle is moved from said first position remote from said cutting blade to said second position adjacent to said cutting blade.

14. A manually-operated cutting tool as set forth in claim 3, wherein:

said base portion of said housing comprises an upstanding rib member; and said pusher element comprises a bifurcated structure having a pair of laterally separated side portions defining a space therebetween for accommodating said rib member of said base portion of said housing and for permitting movement of said pusher element along said base portion of said housing as said handle is moved from said first position remote from said cutting blade to said second position adjacent to said cutting blade.

15. A manually-operated cutting tool as set forth in claim 12, wherein:

said handle comprises a bifurcated structure having a pair of laterally separated side wall portions defining a space therebetween for accommodating said web portion of said housing and for permitting movement of said handle from said first position remote from said cutting blade to said second position adjacent to said cutting blade.

16. A manually-operated cutting tool as set forth in claim 11, further comprising:

a first spring member interposed between said housing and said handle for normally biasing said handle to said first position remote from said cutting blade.

17. A manually-operated cutting tool as set forth in claim 16, wherein:

said portion of said handle comprises a pusher element; and a second spring member is interposed between said handle and said pusher element for normally biasing said pusher element toward said insertion slot.

18. A manually-operated cutting tool as set forth in claim 6, wherein:

an elongated aperture is defined within said housing; and a pin is mounted upon said handle and disposed within said aperture of said housing for limiting the movement of said handle with respect to said housing from said second position adjacent to said cutting blade toward said first position remote from said cutting blade under the influence of said first spring member.

19. A manually-operated cutting tool as set forth in claim 11, further comprising:

means for mounting said cutting blade upon said housing for permitting said cutting blade to be adjustably movable upon said housing whereby new portions of said cutting blade are positioned for performing a cutting operation as said cutting blade experiences wear.

20. A manually-operated cutting tool as set forth in claim 11, wherein:

said handle comprises fingergrip portions; and said housing comprises a palm-support portion, whereby said manually-operable cutting tool is able to be manipulated by an operator in accordance with a one-handed operation.

* * * * *